US008353071B2

(12) United States Patent
Turner et al.

(10) Patent No.: US 8,353,071 B2
(45) Date of Patent: Jan. 15, 2013

(54) REMOVABLE INTEGRATED BOARD AND PARTIAL FOOT SECTION

(75) Inventors: Jonathan D. Turner, Dillsboro, IN (US); David W. Hornbach, Brookville, IN (US); Darrell L. Metz, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 12/957,491

(22) Filed: Dec. 1, 2010

(65) Prior Publication Data

US 2012/0137438 A1 Jun. 7, 2012

(51) Int. Cl.
*A47B 7/02* (2006.01)

(52) U.S. Cl. ..... 5/618; 5/613; 5/610

(58) Field of Classification Search ..... 5/661, 618, 5/613, 616, 617, 620, 53.1, 624, 428, 425, 5/181, 183, 184
See application file for complete search history.

(56) References Cited

U.S. PATENT DOCUMENTS

| | | | | |
|---|---|---|---|---|
| 2,120,732 | A | 6/1938 | Comper et al. | |
| 2,832,655 | A | 4/1958 | Adolphson | |
| 3,195,151 | A | 7/1965 | Boyer | |
| 3,227,440 | A | 1/1966 | Scott | |
| 3,932,903 | A * | 1/1976 | Adams et al. | 5/100 |
| 4,141,117 | A | 2/1979 | Van Gompel | |
| 4,903,354 | A | 2/1990 | Yeh | |
| 4,941,221 | A | 7/1990 | Kanzler | |
| 4,995,067 | A | 2/1991 | Royster et al. | |
| 5,070,555 | A | 12/1991 | Pearson et al. | |
| 5,279,010 | A | 1/1994 | Ferrand et al. | |
| D374,169 | S | 10/1996 | Kopish | |
| 5,628,580 | A | 5/1997 | Rinderer | |
| 5,675,851 | A | 10/1997 | Feathers | |
| D387,655 | S | 12/1997 | Kopish | |
| 5,740,571 | A | 4/1998 | Tyra | |
| 5,873,289 | A | 2/1999 | Jarvis | |
| 5,933,887 | A | 8/1999 | Strange et al. | |
| 6,003,174 | A | 12/1999 | Kantrowitz et al. | |
| 6,182,307 | B1 | 2/2001 | Rutrick | |
| 6,202,230 | B1 | 3/2001 | Borders | |
| 6,212,714 | B1 | 4/2001 | Allen et al. | |
| 6,230,345 | B1 | 5/2001 | Borrero et al. | |
| 6,295,671 | B1 | 10/2001 | Reesby et al. | |
| 6,298,506 | B1 | 10/2001 | Heinold et al. | |
| 6,347,419 | B1 | 2/2002 | Kurtz | |
| 6,496,993 | B2 | 12/2002 | Allen et al. | |
| 6,536,056 | B1 | 3/2003 | Vrzalik et al. | |
| 6,584,630 | B1 | 7/2003 | Dinkler | |

(Continued)

OTHER PUBLICATIONS

Skytron UltraSlide 3600B Product Brochure, Dated Sep. 2010, 12 pages.

(Continued)

*Primary Examiner* — Robert G Santos
*Assistant Examiner* — Richard G Davis
(74) *Attorney, Agent, or Firm* — Barnes & Thornburg LLP

(57) ABSTRACT

A patient support apparatus is convertible between a conventional bed position, having a generally horizontal sleeping surface upon which a person lies in a supine position, and a chair egress position, allowing a person to exit the support from a sitting position. The patient support comprises a deck and a foot panel removably coupled to the deck. The foot panel may allow a low seated height while the bed is in the chair egress position.

20 Claims, 10 Drawing Sheets

U.S. PATENT DOCUMENTS

| | | | | |
|---|---|---|---|---|
| 6,611,979 | B2 | 9/2003 | Welling et al. | |
| 6,612,586 | B2 | 9/2003 | Liou | |
| 6,668,408 | B2 | 12/2003 | Ferrand et al. | |
| 6,679,141 | B1 | 1/2004 | Bozonnet | |
| 6,684,427 | B2 | 2/2004 | Allen et al. | |
| 6,757,924 | B2 | 7/2004 | Goodwin et al. | |
| 6,813,788 | B2 | 11/2004 | Dinkler et al. | |
| 6,874,179 | B2 | 4/2005 | Hensley et al. | |
| 6,880,189 | B2 | 4/2005 | Welling et al. | |
| 6,904,631 | B2 | 6/2005 | Vrzalik et al. | |
| 6,941,598 | B2 | 9/2005 | Ferrand et al. | |
| 7,000,272 | B2 * | 2/2006 | Allen et al. | 5/624 |
| 7,107,636 | B2 | 9/2006 | Metz et al. | |
| 7,188,380 | B1 | 3/2007 | Wang | |
| 7,216,384 | B2 | 5/2007 | Allen et al. | |
| 7,237,284 | B2 | 7/2007 | Hensley et al. | |
| 7,296,312 | B2 | 11/2007 | Menkedick et al. | |
| 7,346,945 | B2 | 3/2008 | Phillips et al. | |
| 7,350,248 | B2 | 4/2008 | Hensley et al. | |
| 7,406,731 | B2 | 8/2008 | Menkedick et al. | |
| 7,426,760 | B2 | 9/2008 | Vrzalik | |
| 7,469,433 | B2 | 12/2008 | Ruehl et al. | |
| 7,506,390 | B2 | 3/2009 | Dixon et al. | |
| 7,520,006 | B2 | 4/2009 | Menkedick et al. | |
| 7,520,008 | B2 | 4/2009 | Wong et al. | |
| 7,523,515 | B2 | 4/2009 | Allen et al. | |
| 7,669,263 | B2 | 3/2010 | Menkedick et al. | |
| 7,703,158 | B2 | 4/2010 | Wilker, Jr. et al. | |
| 7,775,600 | B2 | 8/2010 | Battey et al. | |
| 7,827,632 | B2 | 11/2010 | Vrzalik | |
| 7,934,276 | B2 | 5/2011 | Newkirk et al. | |
| 7,975,332 | B2 | 7/2011 | Hensley et al. | |
| 2006/0021144 | A1 * | 2/2006 | Hornbach et al. | 5/618 |
| 2006/0225212 | A1 * | 10/2006 | Parson et al. | 5/618 |

OTHER PUBLICATIONS

Hill-Rom 820 Bed Service Manual, date unknown, p. 82023.

* cited by examiner

REMOVABLE INTEGRATED BOARD AND PARTIAL FOOT SECTION

BACKGROUND

The present disclosure relates to a patient support apparatus, such as a hospital bed, for supporting a patient. More particularly, the present disclosure relates to a deck section with an integrated foot panel.

Hospital beds known in the art are configured to move between a conventional bed position, wherein the patient support surface is generally flat, and a chair egress position, wherein the foot-end portion of the patient support surface is lowered so that a patient can egress or exit the bed from a sitting position. The length of the foot-end portion of the patient support surface that is lowered typically defines the minimum seat height of a bed in the chair egress position. It is often desirable to minimize the seat height of a bed in the chair egress position to facilitate safe patient egress from the bed.

In the prior art, when the foot-end of the patient support surface is lowered, the foot-end of the patient support surface has been retracted to minimize the bed seat height. Patient support surface retraction can require complex combinations of mechanical and electrical components to be integrated into a bed.

SUMMARY

The present application discloses one or more of the features recited in the appended claims and/or the following features which, alone or in any combination, may comprise patentable subject matter.

A patient support apparatus may comprise a deck, having a head-end and a foot-end and defining a first support surface having a first support area, and a foot panel removably coupled to the deck. The foot panel may include (i) a foot panel body, (ii) a foot panel deck portion extending generally perpendicularly from the foot panel body toward the head-end of the panel, and (iii) a first foot panel post extending generally parallel to and beyond the foot panel deck portion toward the head-end of the deck. The post may engage the deck such that the deck portion of the foot panel cooperates with the deck to form a second support surface. The first and the second support surface may define a second support area larger than the first support area.

The deck may also include a first receiving socket to receive the first foot panel post.

The foot panel may further include a second foot panel post extending generally parallel to and beyond the foot panel deck portion toward the head-end of the deck. The deck may include a second receiving socket to receive the second foot panel post.

The patient support may further comprise a mattress supported at least partially by the first support surface. The foot panel deck portion may underlie a portion of the mattress.

The mattress may include a mattress extender supported on the second support surface. The mattress extender may be an inflatable mattress extender.

The deck further may further include a foot panel retainer movable between a locked and an unlocked position. When the retainer is in the unlocked position, the first post may be removable from the first receiving socket.

The deck may further include a head deck section, a seat deck section, a thigh deck section, and a foot deck section. The foot panel retainer may move to the unlocked position when the foot deck section is positioned at an angle relative to horizontal greater than a minimum release angle.

When the foot deck section is positioned at an angle, relative to horizontal, less than the minimum release angle, the foot panel retainer may also be movable between the unlocked position and locked position by using an implement.

In other embodiments, a patient support apparatus may comprise a base, a deck, and a foot panel. The deck may be supported above the base. Further, the deck may be configured to move between a conventional bed position and a chair egress position. The deck may include a head deck section, a seat deck section, a thigh deck section, and a foot deck section. The foot panel may be removably coupled to the foot deck. The foot panel may include (i) a foot panel body extending generally perpendicularly to the foot deck section and (ii) a foot panel deck portion extending from the foot panel body within a plane defined by the foot deck section.

The foot deck section may be movable between an extended position and a retracted position. The foot deck section may be configured to be retracted toward the thigh deck when the deck is moved to the chair egress position. The foot deck section may also be configured to be extended when the deck is moved to the conventional bed position.

The bed may further include a mattress assembly and the mattress assembly may include a mattress extender. The mattress extender may be deflated when the deck is moved to the chair egress position.

The bed may further comprise a foot deck alarm activated when the foot deck section passes through a minimum release angle relative to horizontal. The foot deck alarm may be an audible alarm.

The deck may be configured to pause movement between the conventional bed position and the chair egress position when the foot deck section passes through a minimum release angle relative to horizontal.

The minimum release angle may be about 70 degrees.

BRIEF DESCRIPTION OF THE DRAWINGS

The detailed description particularly refers to the accompanying figures, in which.

DETAILED DESCRIPTION OF THE DRAWINGS

Figure 1:
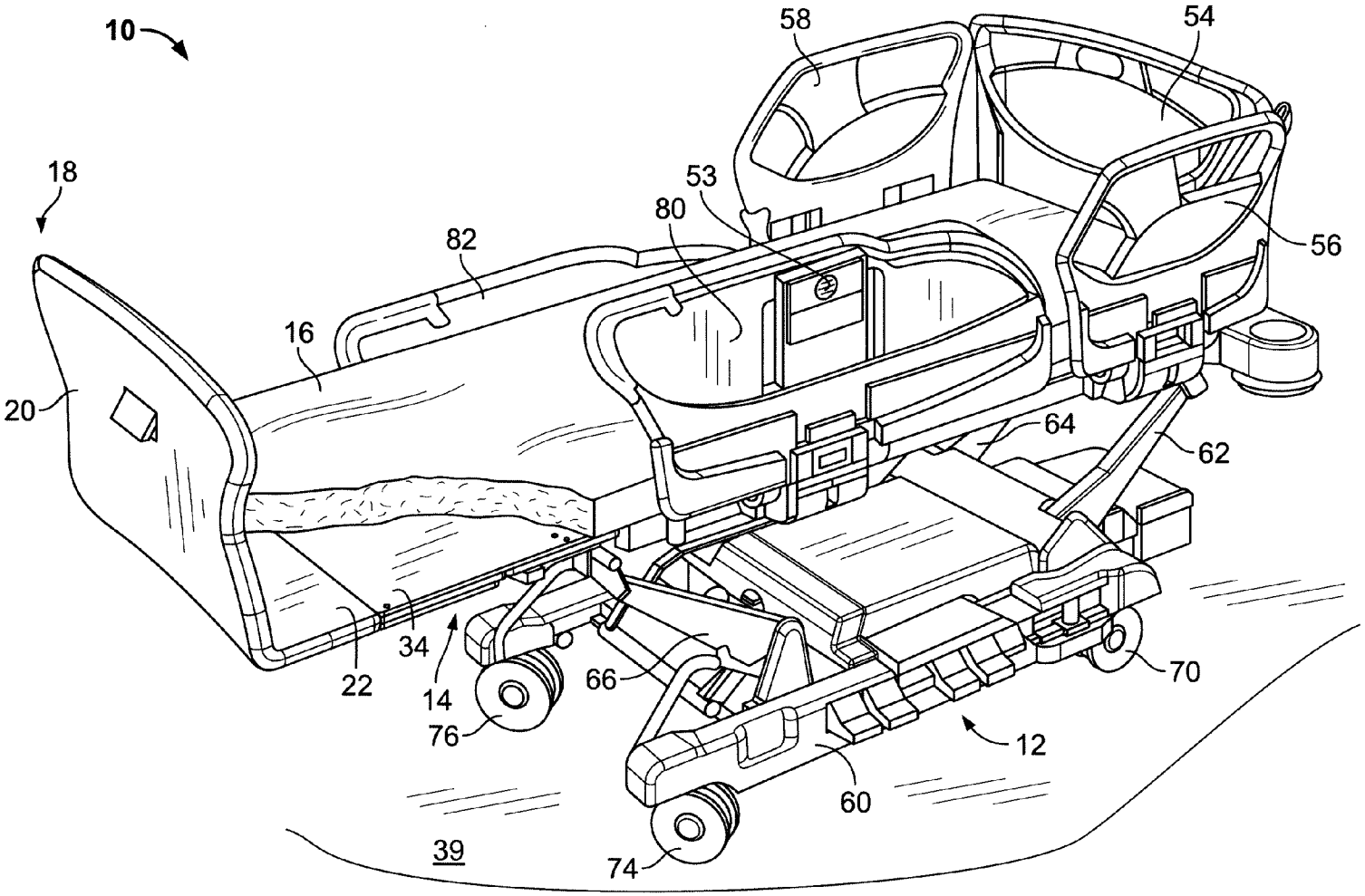
FIG. 1 is a perspective view of a patient support apparatus embodied as a hospital bed showing the chair bed in a conventional bed position and including a foot panel coupled to a foot-end of a deck of the chair bed.
Figure 2:
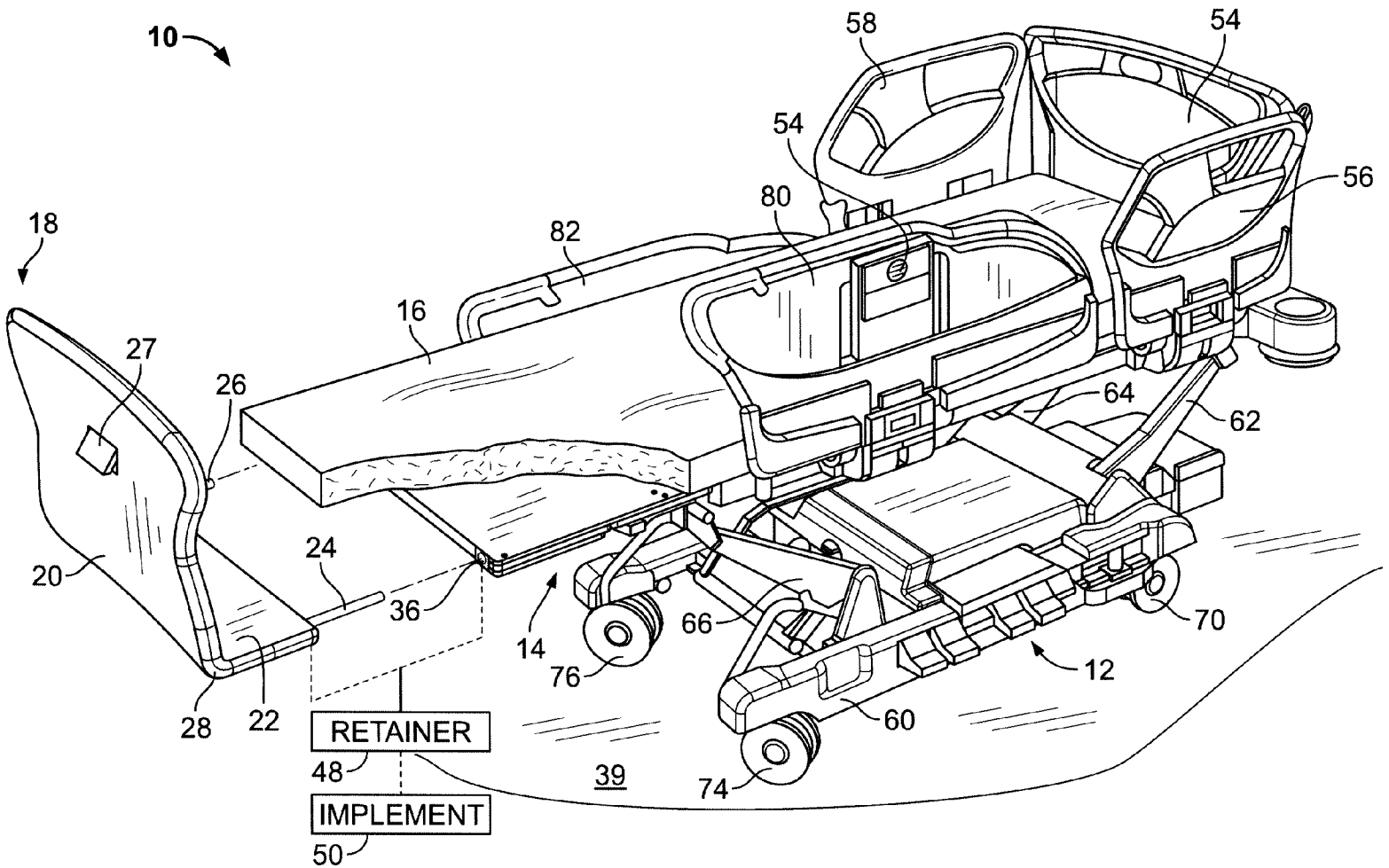
FIG. 2 is a perspective view similar to FIG. 1 with the foot panel is exploded from the chair bed.

A patient support apparatus is illustratively embodied as a bed 10 having a base 12, a deck 14, and a mattress assembly 16 as shown in FIG. 1. The deck 14 is supported by the base 12. The deck 14 supports the mattress assembly 16. The bed 10 is movable between a conventional bed position, wherein the deck 14 is generally flat, and a chair egress position, wherein the deck 14 is moved from the conventional bed position so that the patient support apparatus 10 is configured to allow a patient to egress or exit the bed 10 from a sitting position.

The bed 10 further includes a foot panel 18 that is removably coupled to the foot-end of the deck 14. The foot panel 18 includes a foot panel body 20, a foot panel deck portion 22, a first foot panel post 24 and a second foot panel post 26. As discussed in greater detail below, the foot panel 18 is removable.

The deck 14 includes a head deck section 28, a seat deck section 30, a thigh deck section 32, and a foot deck section 34. Each of the deck 14 sections 28, 30, 32, 34, is articulated and movable relative to so that the bed 10 moves between the conventional bed position and the chair egress position.

Figure 3:
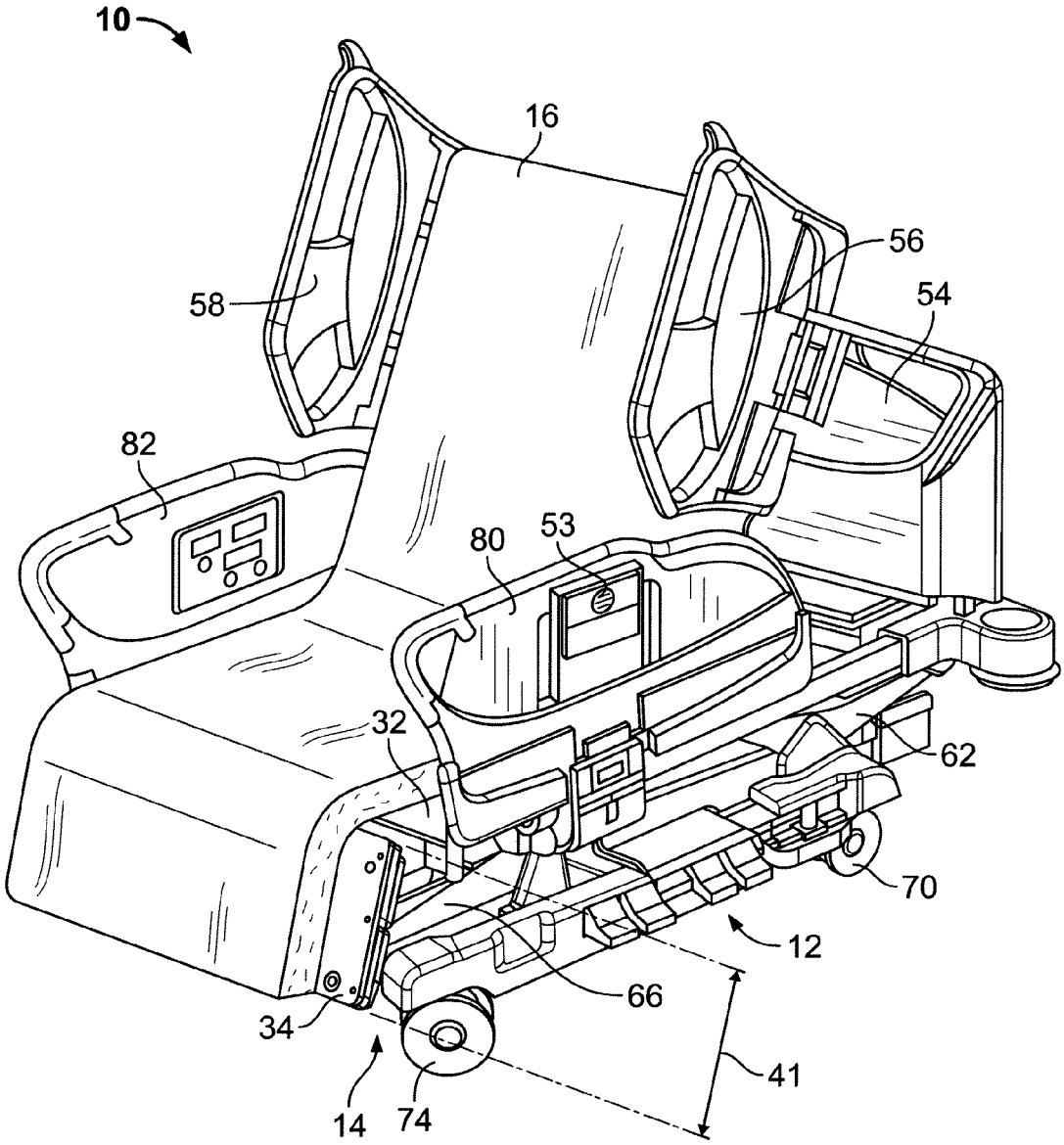
FIG. 3 is a perspective view of a chair bed showing the chair bed in a chair egress position wherein the foot panel is removed from the chair bed.

The foot deck section 34 includes a first receiving socket 36 and a second receiving socket 38 each sized to receive the first and the second foot panel posts 24, 26. Additionally, the foot deck section 34 moves between an extended position and a retracted position. The foot deck section 34 is moved to the extended position when the bed 10 is moved to the conventional bed position. The foot deck section 34 is moved to the retracted position when the bed 10 is moved to the chair egress position as shown in FIG. 3. In some embodiments, the foot deck section 34 may include an obstacle sensor such as a proximity sensor at the foot end of the foot deck section 34. In such embodiments, movement of the bed 10 to the chair egress position may be paused, slowed, or reversed when the proximity sensor indicates an obstacle between the foot deck section 34 and the floor 39.

The foot panel body 20 extends along a foot-end of the mattress assembly 16 and above a top surface of the mattress assembly 16, when the mattress assembly 16 is present. The illustrative foot panel body 20 is constructed of a polymeric material and is unitarily formed along with the foot panel deck portion 22. In other embodiments, the foot panel body 20 and the foot panel deck portion 22 may be separately constructed. The foot panel body 20 includes a handle 27 to facilitate manipulation of the foot panel 18 or the bed 10.

The foot panel deck portion 22 is coupled to the foot panel body 20. The foot panel deck portion 22 extends generally perpendicularly from the foot panel body 20 toward the foot deck section 34 of the deck 14. The foot panel deck portion 22 supports a portion of the mattress assembly 16 beyond the foot-end of the deck 14. The foot panel deck portion 22 is illustratively configured to support a mattress assembly 16 with a maximum length of 84 inches. In other embodiments, the foot panel deck portion 22 is configured to support a mattress assembly 16 with a maximum length of 80 inches or some other maximum length.

While the bed 10 is in the chair egress position, a minimum height 41 of the seat and thigh deck sections 30, 32, is determined by the distance between the foot-end of the thigh deck section 32 and the foot-end of the bed 10. While the foot panel 18 is coupled to the deck 14, the foot-end of the bed 10 is defined by the foot-end of the foot panel 18. In this configuration, the minimum distance between the foot-end of the thigh deck section 32 and the foot-end of the bed 10 is the length of the foot panel 18 coupled to the foot deck section 34, in the retracted position. When the foot panel 18 is removed from the deck 14, the foot end of the bed 10 is defined by the foot-end of the foot deck section 34. Consequently, the minimum distance between the foot-end of the thigh deck section 32 and the foot-end of the bed 10 is the foot deck section 34 length, in the retracted position. Thus, in some embodiments, removal of the foot panel 18 reduces the achievable minimum height 41 of the seat and thigh deck sections 30, 32, relative to the floor 39 while the bed is in the chair egress position.

Figure 4:
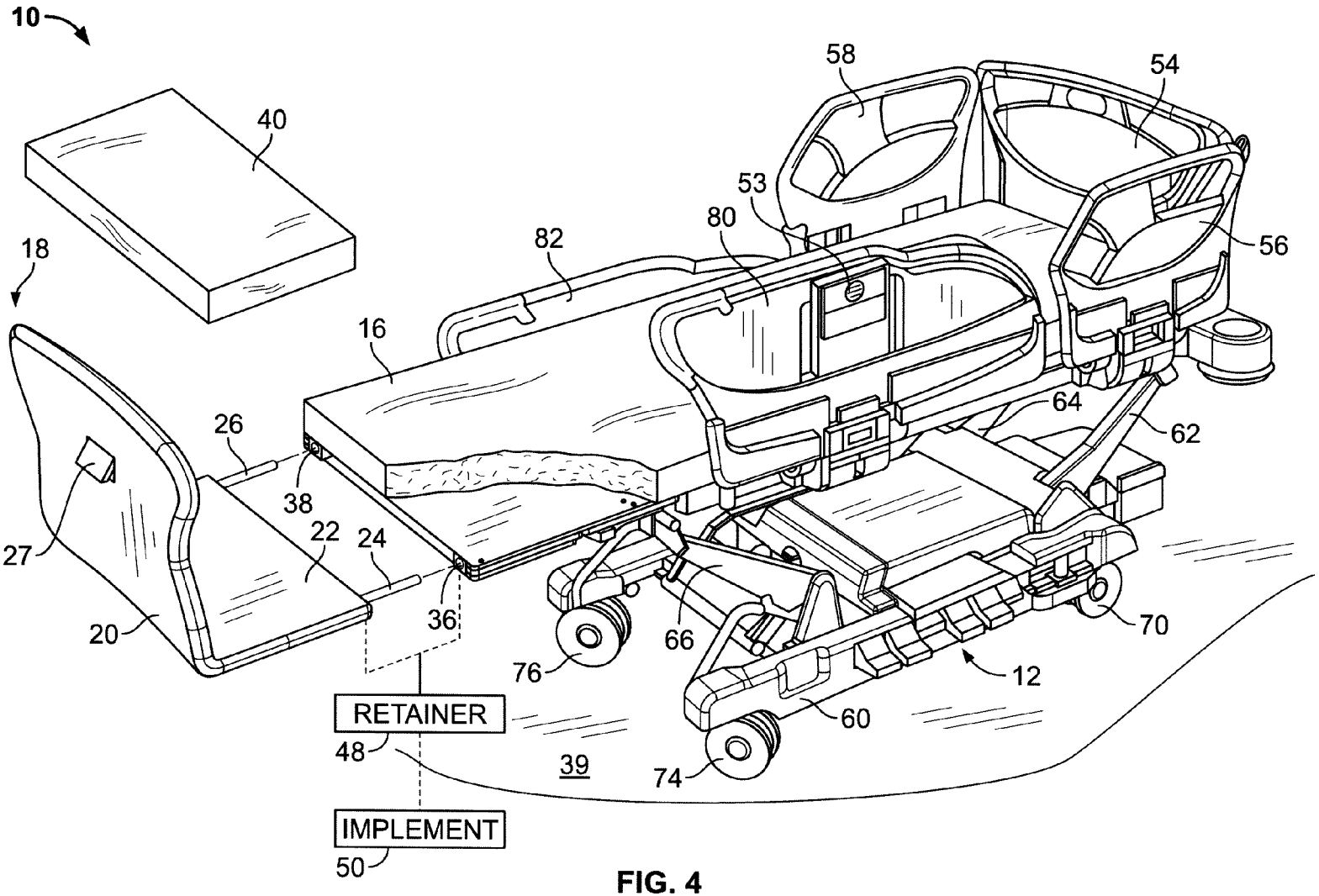
FIG. 4 is a perspective view of the bed of FIG. 1 in a conventional bed position with the foot panel is exploded from the chair bed and a mattress and a removable mattress extender.
Figure 5:
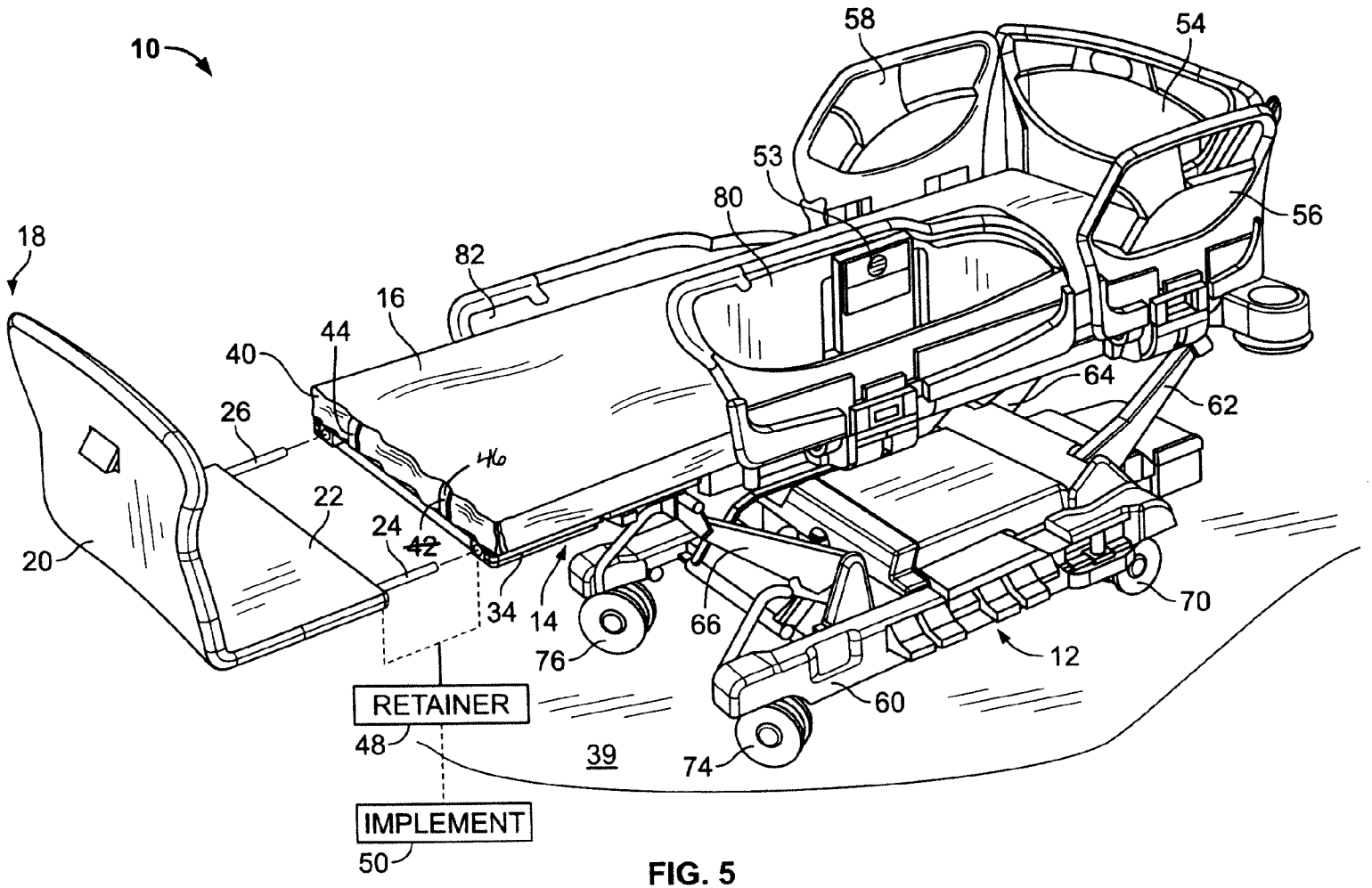
FIG. 5 is an exploded perspective view of the bed with a mattress assembly including a deflated mattress extender.
Figure 6:
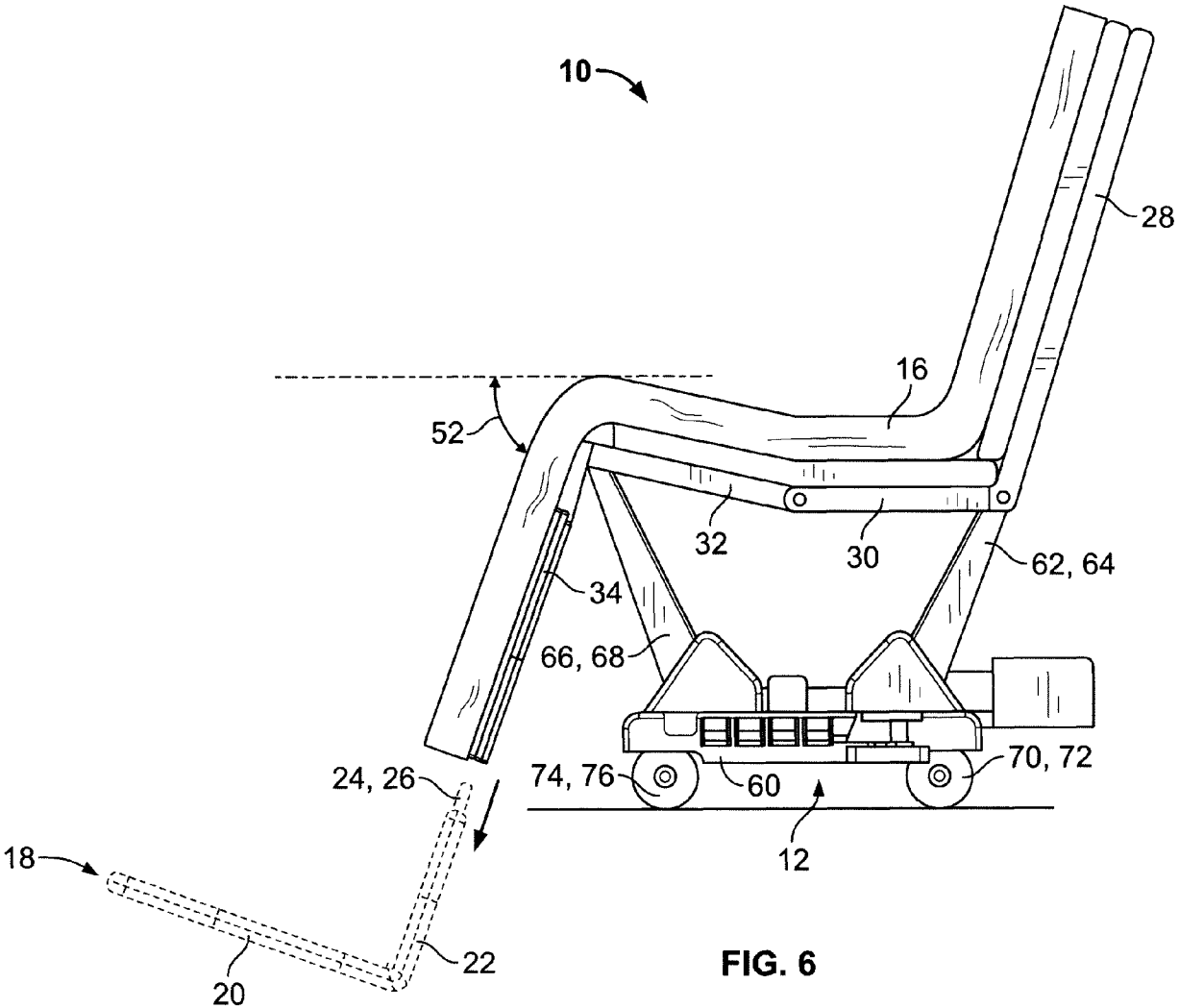
FIG. 6 is a side view of the bed positioned between a conventional position and a chair egress position indicating an angle of a foot deck section relative to horizontal.
Figure 7:
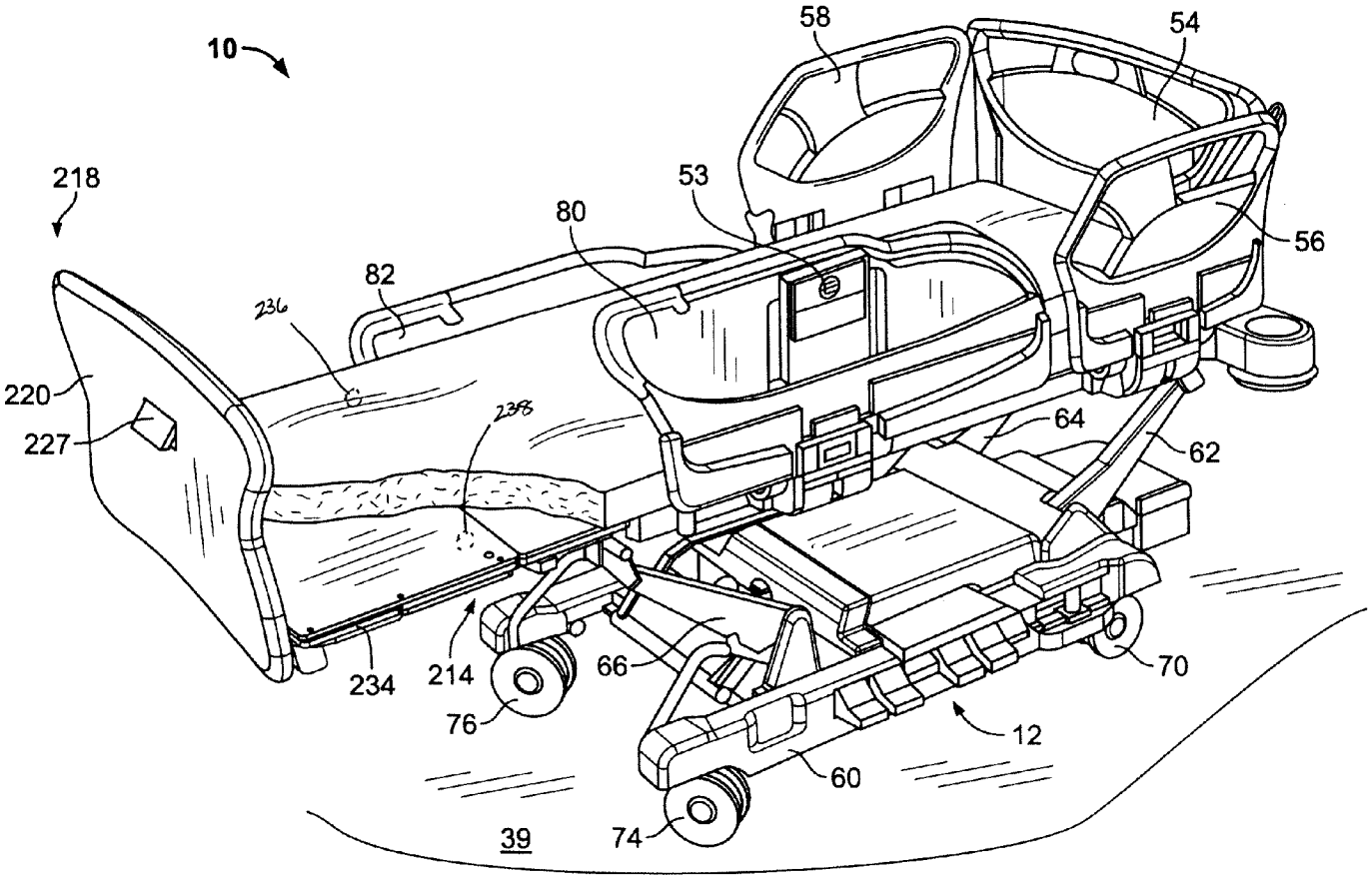
FIG. 7 is a perspective view of the bed including another embodiment of the foot panel.
Figure 8:
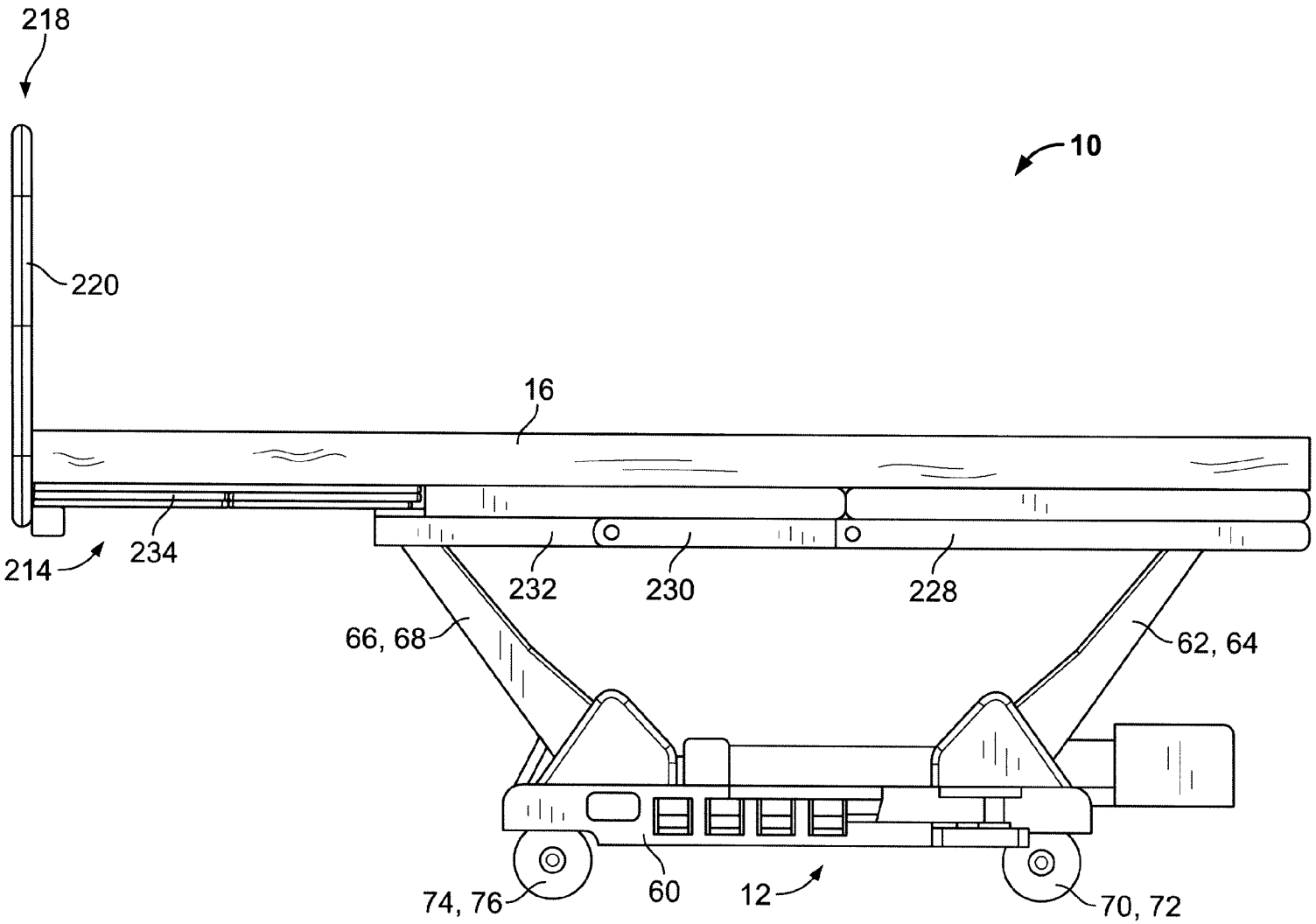
FIG. 8 is a side view of a chair bed during in the horizontal position and including the alternative embodiment of the foot panel coupled to the foot-end of the deck of the chair bed.
Figure 9:
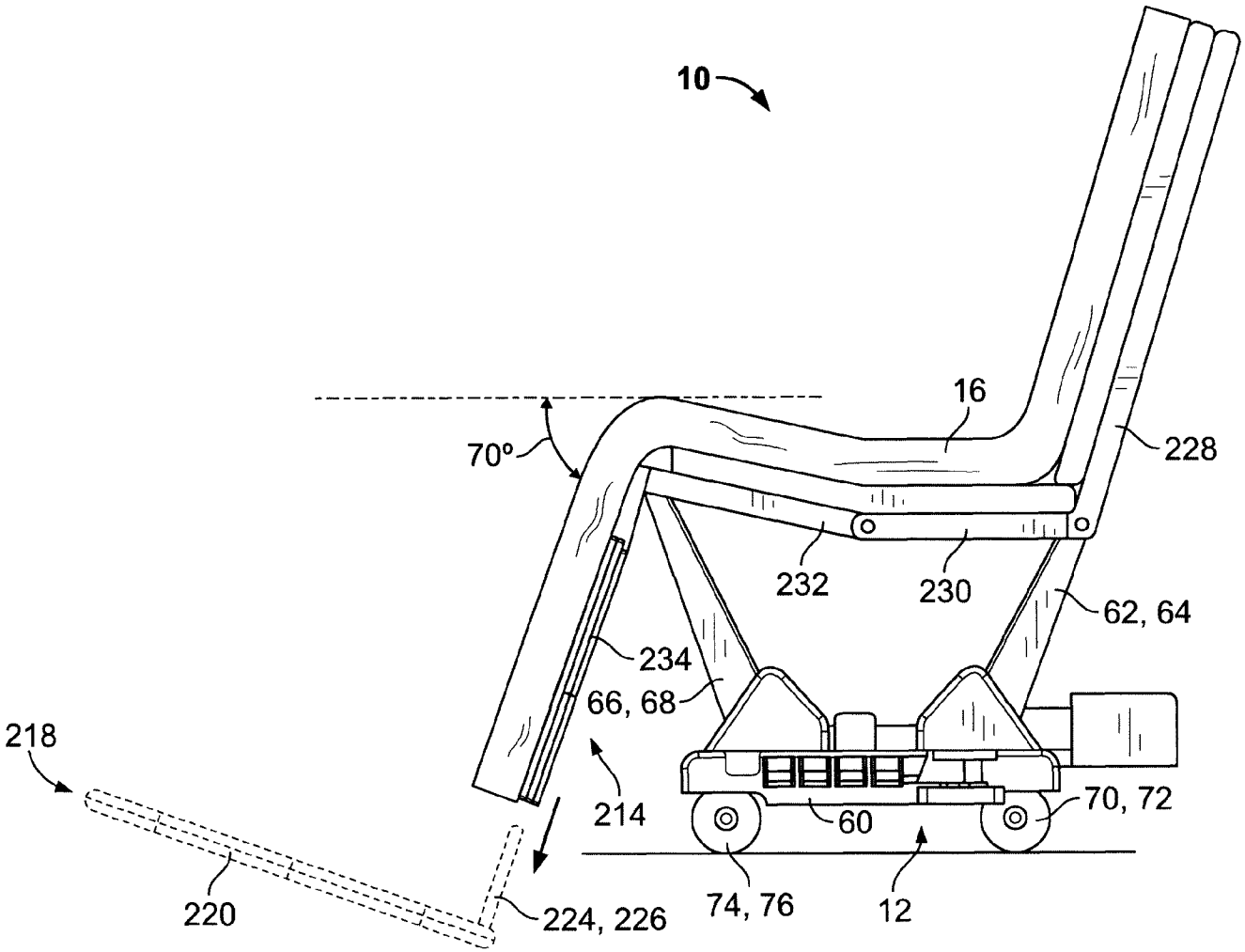
FIG. 9 is a side view of the bed between a conventional bed position and a chair egress position with the embodiment of the foot panel of FIG. 7 at an angle of the foot deck section relative to horizontal at which the foot panel may be removed.
Figure 10:
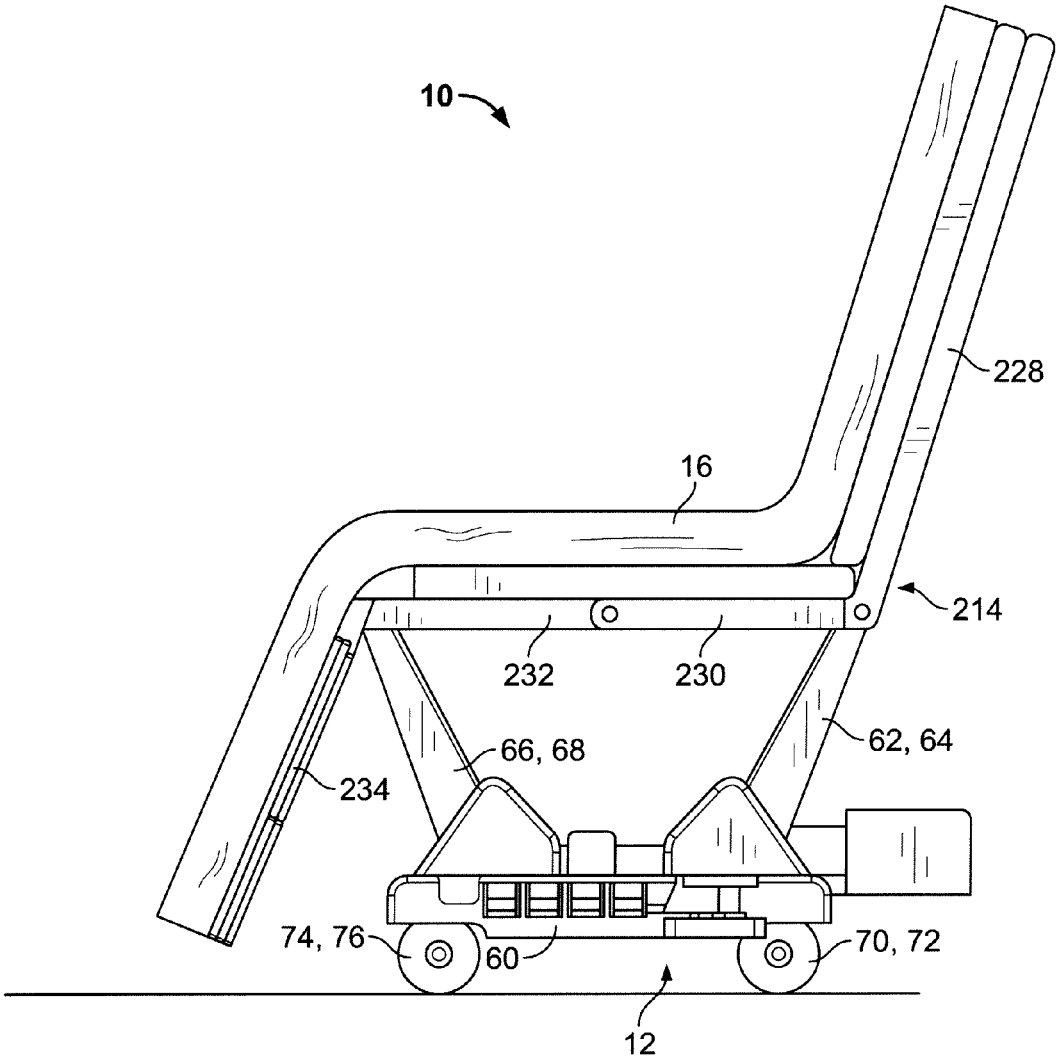
FIG. 10 is a side view of the bed in a chair egress position with the foot panel removed from the chair bed.

The mattress assembly 16 includes a mattress extender 40, as shown in FIG. 4. The mattress extender 40 is removed from the support of the foot panel deck section 34 by being lifted off the foot panel deck portion 22. In other embodiments, the mattress extender 40 is deflated and secured by elastic straps 44, 46, to the foot-end of the mattress assembly 16 as shown in FIG. 5. In other embodiments, Velcro™ straps, snaps, or other mechanisms are used to secure the mattress extender 40 to the foot end of the mattress assembly 16.

The first and the second foot panel posts 24, 26, extend beyond the foot panel deck portion 22 toward the head end of the deck 14. The first and the second receiving sockets 36, 38, receive the first and the second foot panel posts 24, 26. The first and the second foot panel posts 24, 26, are coupled to the first and the second receiving sockets 36, 38, by a retainer 48.

The retainer 48 is movable between an unlocked position, wherein the first and the second foot panel posts 24, 26, are removable from the first and the second receiving sockets 36, 38, and a locked position, wherein the first and the second foot panel posts 24, 26, are not removable from the first and the second receiving sockets 36, 38.

The retainer 48 is movable between the unlocked position and the locked position by using an implement 50. Keys, standard tools, and custom tools are contemplated as potential implements 50 for moving the retainer 48 between the unlocked position and the locked position. Further, other items such as writing pens, coins, identification badges, electronic key fobs, and the like are also contemplated as potential implements 50 for moving the retainer 48 between the unlocked position and the locked position. The retainer 48 in the locked position prevents unwanted de-coupling or manipulation of the foot panel 18.

Additionally, the retainer 48 is moved between the locked position and the unlocked position depending upon the position of the deck 14. Specifically, the retainer 48 is moved to the unlocked position while the foot deck section 34 is oriented at an angle, relative to horizontal, greater than a minimum release angle 52. Conversely, the retainer 48 is moved to the locked position while the foot deck section 34 is oriented at an angle, relative to horizontal, less than the minimum release angle 52. The retainer 48 is mechanically constructed utilizing a pendulum arrangement to induce movement at the minimum release angle 52. In other embodiments, the retainer 48 is electronically constructed utilizing position sensors and solenoids to induce movement at the minimum release angle 52. Notably, the retainer 48 is movable to the unlocked position by using the implement 50 even while the foot deck section 34 is oriented at an angle, relative to horizontal, less than a minimum release angle 52. In the illustrative embodiment, the minimum release angle is about 70 degrees. In other embodiments, the minimum release angle 52 is another angle.

The bed 10 includes a foot deck alarm 53. The foot deck alarm 53 alerts a caregiver that the foot panel 18 should be removed from or installed onto the deck 14. The foot deck alarm 53 issues an alert to remove the foot panel 18 when the foot deck section 34 is oriented at an angle, relative to horizontal, greater than the minimum release angle 52. The foot deck alarm 53 issues an alert to install the foot panel 18 when the foot deck section 34 is oriented at an angle, relative to horizontal, less than the minimum release angle 52. The foot deck alarm 53 issues an audible alert, a visual alert, or another warning to inform a caregiver of a suggested action relating to the foot panel 18.

The deck 14 is configured to stop movement between the conventional bed position and the chair egress position when the foot deck section 34 is oriented at, or about, the minimum release angle 52. Movement of the deck 14 resumes upon a caregiver input to the bed 10 or upon installation or removal of the foot panel 18.

The bed 10 includes a head panel 54, a first headrail 56, and a second headrail 58. The head panel 54 extends along the head-end of the deck 14 and extends above the top surface of the mattress assembly 16, when the mattress assembly 16 is present. The head panel 54 is removable from the bed 10. The first and the second headrails 56, 58, are adjacent to the head panel 54, and extend generally perpendicular to the head panel 54, along the deck 14. The first and the second headrails 56, 58, extend above the top surface of the mattress assembly 16, when the mattress assembly 16 is present, and are adjustable across a predetermined range of heights. Also, the first and the second headrails 56, 58, are removable from the bed 10. The head panel 54 and headrails 56, 58, prevent patient entry to, and egress from, the bed 10 near the head-end of the bed 10 in the conventional bed position.

The base 12 includes a base frame 60, a first and a second head-end strut 62, 64, a first and second foot-end strut 66, 68, a first and a second head-end caster 70, 72, and a first and a second foot-end caster 74, 76. The first and the second head-end struts 62, 64, are coupled to the head-end of base frame 60 and to the deck 14 near the head-end of the deck 14. The first and the second foot-end struts 66, 68, are coupled to the foot-end of the base frame 60 and to the deck 14 such that the foot-end of the deck 14 is cantilevered over the base 12. The first and the second head-end casters 70, 72, are coupled to the base frame 60 near the head-end of the base frame 60 and engage the floor 39. The first and the second foot-end casters 74, 76, are coupled to the base frame 60 near the foot-end of the base frame 60 and engage the floor 39.

The bed 10 also includes a first siderail 80 and a second siderail 82. The first and the second siderails 80, 82, extend generally perpendicularly to the foot panel body 20, along the deck 14. The first and the second siderails 80, 82, extend above the top surface of the mattress assembly 16, when the mattress assembly 16 is present, and are adjustable across a predetermined range of heights. Also, the first and the second siderails 80, 82, are removable from the bed 10.

The bed 10 is shown in FIGS. 7-10 with another foot panel embodiment (hereinafter referenced as a foot panel 218). Some features of the embodiment illustrated in FIG. 4 are substantially similar to those discussed above in reference to the embodiment of FIGS. 1-6. Such features are designated in FIGS. 7-10 with the same reference numbers as those used in FIGS. 1-6.

The bed 10 alternately includes a foot panel 218 that is removably coupled to the foot-end of a deck 214. The foot panel 218 includes a foot panel body 220 and a first and a second foot panel post 224, 226. As discussed in detail below, the foot panel 218 is removable.

The foot panel body 220 extends along a foot-end of the mattress assembly 16 and above a top surface of the mattress assembly 16, when the mattress assembly 16 is present. The foot panel body 220 is constructed of a polymeric material. In other embodiments, other suitable materials are employed in construction of the foot panel body 220. The foot panel body 220 includes a handle 227 to facilitate manipulation of the foot panel 218 or the bed 10.

The deck 214 includes a head deck section 228, a seat deck section 230, a thigh deck section 232, and a foot deck section 234 movable relative to one another to change the configuration of the deck 214. The foot deck section 234 includes a first and a second receiving socket 236, 238 sized to receive the first and the second foot panel posts 224, 226.

Additionally, the foot deck section 234 moves between an extended position and a retracted position. The foot deck section 234 is moved to the extended position when the bed 10 is moved to the conventional bed position so that the entire length of the mattress assembly 16 is supported by the deck 214. The foot deck section is moved to the retracted position when the bed 10 is moved to the chair egress.

While the bed 10 is in the chair egress position, the minimum height 41 of the seat and thigh deck sections 230, 232, is determined by the distance between the foot-end of the thigh deck section 232 and the foot-end of the bed 10. While the foot panel 218 is coupled to the deck 214, the foot-end of the bed 10 is defined by the foot-end of the foot panel 218. In this configuration, the minimum distance between the foot-end of the thigh deck section 232 and the foot-end of the bed 10 is the length of the foot panel 218 coupled to the foot deck section 234, in the retracted position. When the foot panel 218 is removed from the deck 214, the foot end of the bed 10 is defined by the foot-end of the foot deck section 234. Consequently, the distance between the foot-end of the thigh deck section 232 and the foot-end of the bed 10 is the length of the foot deck section 234, in the retracted position. Thus, while the bed 10 is in the chair egress position, removal of the foot panel 218 reduces the minimum height of the seat and thigh deck sections 230, 232, relative to the floor 39 by about the thickness of the foot panel body 220.

Although certain illustrative embodiments have been described in detail above, variations and modifications exist within the scope and spirit of this disclosure as described and as defined in the following claims.

The invention claimed is:

1. A patient support apparatus comprising a deck having a head-end and a foot-end and defining a first support surface having a first support area, and a foot panel removably coupled to the deck, the foot panel including (i) a foot panel body, (ii) a foot panel deck portion extending generally perpendicularly from the foot panel body toward the head-end of the panel, the foot panel deck portion including a head-end that confronts the foot-end of the deck when the foot panel is coupled to the deck, and (iii) a first foot panel post extending generally parallel to and beyond the foot panel deck portion toward the head-end of the deck, the post engaging the deck such that the deck portion of the foot panel cooperates with the deck to form a second support surface, the first and the second support surface defining a second support area larger than the first support area.

2. The patient support apparatus of claim 1, wherein the deck includes a first receiving socket to receive the first foot panel post.

3. The patient support apparatus of claim 2, wherein the foot panel further includes a second foot panel post extending generally parallel to and beyond the foot panel deck portion toward the head-end of the deck and the deck includes a second receiving socket to receive the second foot panel post.

4. The patient support apparatus of claim 3, wherein the patient support further comprises a mattress supported at least partially by the first support surface and the foot panel deck portion underlies a portion of the mattress.

5. The patient support apparatus of claim 4, wherein the mattress includes a mattress extender supported on the second support surface.

6. The patient support apparatus of claim 5, wherein the mattress extender is an inflatable mattress extender.

7. The patient support apparatus of claim 2, wherein the deck further includes a foot panel retainer movable between a locked and an unlocked position, the first post removable from the first receiving socket when the retainer is in the unlocked position.

8. The patient support apparatus of claim 7, wherein the deck comprises a head deck section, a seat deck section, a thigh deck section, and a foot deck section and the foot panel retainer moves to the unlocked position when the foot deck section is positioned at an angle relative to horizontal greater than a minimum release angle.

9. The patient support apparatus of claim 8, wherein the foot panel retainer is movable between the unlocked position and locked position with the use of an implement when the foot deck section is positioned at an angle relative to horizontal less than the minimum release angle.

10. The patient support apparatus of claim 9, wherein the minimum release angle is about 70 degrees.

11. The patient support apparatus of claim 1 further comprising a base;

wherein the deck is supported above the base, the deck configured to move between a conventional bed position and a chair egress position, the deck including a head deck section, a seat deck section, a thigh deck section, and the foot deck section; and wherein the foot panel body is positioned within a space defined by a plane defined by the first support surface of the foot deck section and a plane defined by a lower surface of the foot deck section.

12. The patient support apparatus of claim 11, wherein the foot deck section is movable between an extended position and a retracted position.

13. The patient support apparatus of claim 12, wherein the foot deck section is configured to be retracted toward the thigh deck when the deck is moved to the chair egress position.

14. The patient support apparatus of claim 13, wherein the foot deck section is configured to be extended when the deck is moved to the conventional bed position.

15. The patient support apparatus of claim 14, wherein the bed further includes a mattress assembly and the mattress assembly includes a mattress extender.

16. The patient support apparatus of claim 15, wherein the mattress extender is deflated when the deck is moved to the chair egress position.

17. The patient support of claim 11, wherein a foot deck alarm is activated when the foot deck section passes through a minimum release angle relative to horizontal.

18. The patient support apparatus of claim 17, wherein the foot deck alarm is an audible alarm.

19. The patient support apparatus of claim 17, wherein the minimum release angle is about 70 degrees.

20. The patient support apparatus of claim 11, wherein the deck is configured to pause movement between the conventional bed position and the chair egress position when the foot deck section passes through a minimum release angle relative to horizontal.

* * * * *